US005482282A

United States Patent [19]

Willis

[11] Patent Number: 5,482,282

[45] Date of Patent: Jan. 9, 1996

[54] GOLF CLUB

[76] Inventor: Samuel C. Willis, 1001 Ironwood Dr., Bowling Green, Ky. 42103

[21] Appl. No.: 362,194

[22] Filed: Dec. 22, 1994

[51] Int. Cl.[6] ..... A63B 69/36

[52] U.S. Cl. ..... 273/186.2; 273/167 R; 273/167 H

[58] Field of Search ..... 273/167 R, 162 R, 273/77 R, 170, 78, 162 D, 167 H, 173, 186.1, 187.1, 186.2, 193 R, 194 R, 187.4, 443, 448, 456, 187.2

[56] References Cited

U.S. PATENT DOCUMENTS

| | | | |
|---|---|---|---|
| 2,592,013 | 4/1952 | Curley | 273/170 |
| 4,017,082 | 4/1977 | Channing | 273/162 D |
| 4,027,886 | 6/1977 | Katsube | 273/456 |
| 4,135,720 | 1/1979 | Lancellotti | 273/170 |
| 4,248,430 | 2/1981 | Kepler | 273/162 D |
| 4,615,526 | 10/1986 | Yasuda | 273/187.1 |
| 5,169,151 | 12/1992 | Conley | 273/186.2 |
| 5,366,222 | 11/1994 | Lee | 273/170 |

*Primary Examiner*—Sebastiano Passaniti
*Attorney, Agent, or Firm*—Veal & Marsh

[57] ABSTRACT

A novel club construction utilizes a permanent magnet fixed within the club head at a selected spot. Separated from the magnet by a non-magnetic spacer material is a keeper of ferromagnetic material which is believed to shape the flux field of the permanent magnet. This combination is used to establish a permanent field of flux within the club head.

16 Claims, 3 Drawing Sheets

GOLF CLUB

FIELD OF THE INVENTION

The present invention relates generally to golf clubs and more particularly to those clubs known as woods and which are used to drive a golf ball over the major distances of a golf course. In greater particularity the present invention is directed to the internal construction of such a golf club and in even greater particularity the present invention is directed to the use of magnets within the golf club head.

BACKGROUND

Every golfer knows that the longest shot and the shortest shot each count equally in the stroke total that measures the golfer against par. Every golfer also knows that he comes to certain tees, with great expanses of fairway in front of him, wishing for an extra bit of yardage from his tee shot. The mental aspect of the game often causes the golfer to over swing off the tee resulting in a shot that leaves the perplexed duffer wishing for even greater distance from his fairway wood. Likewise, the habits of certain golfers have given their game a noticeable set of tendencies of ball movement. That is to say, some golfers tend to fade the ball while others tend to hook the ball. The kinetics of the golf swing are well understood and are documented in numerous works such as "The Search for the Perfect Swing" by Alastair Cochran and John Stobbs. In this work these authors have determined that it makes very little difference if the total club weight is varied in the achieved distance which the ball is struck. As is also recognized the rules of golf forbid the use of a club so far out of the norm as to give the golfer an "unfair" advantage. Accordingly, the instant inventor set out to increase the distance achieved by improving on the club. Serendipitously, while searching for an answer using another theory the present invention was discovered.

SUMMARY OF THE INVENTION

It is the principal object of the present invention to provide a golf club of essentially the same weight as a conventional club which will provide an average increase in the distance a ball is driven by the club.

Another object of the invention is to provide the ability to tune a golf club to reduce the characteristic movement of the ball by a golfer.

The ultimate object of the invention is to make the game of golf more enjoyable by increasing the potential for good shots by the golfer.

These and other objects of the invention are accomplished by a novel club construction the effects of which are not fully understood by the inventor yet which are documented by empirical testing. In my club construction, I utilize a permanent magnet fixed within the club head at a selected spot. Separated from the magnet by a non-magnetic spacer material is a keeper of ferromagnetic material which is believed to shape the flux field of the permanent magnet. This combination is used to establish a permanent field of flux within the club head.

BRIEF DESCRIPTION OF THE DRAWINGS

A golf club incorporating features of my invention are depicted in the accompanying drawings which form portion of this disclosure and wherein.

DESCRIPTION OF A PREFERRED EMBODIMENT

Figure 1:
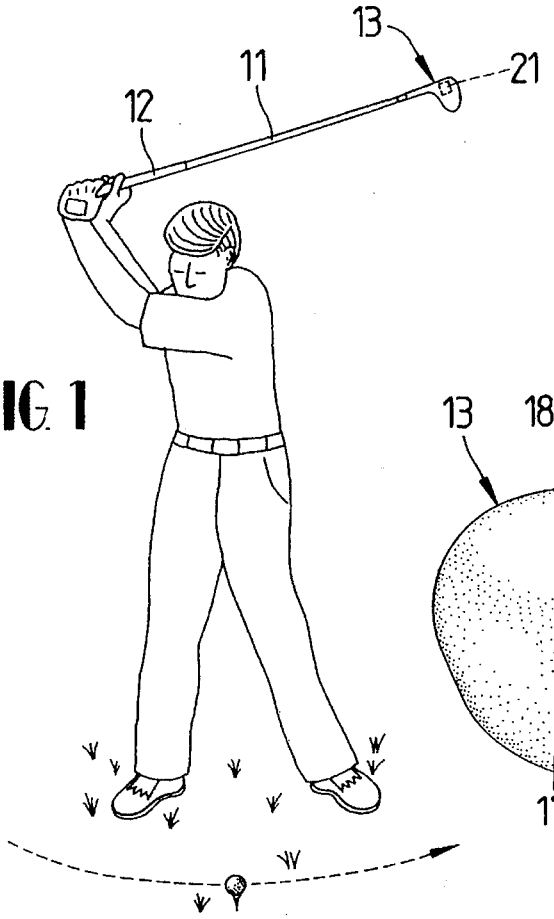
FIG. 1 is an elevational view of a golfer in mid-swing about to strike the ball with a driver.

Referring to the drawings for a clearer understanding of the invention, it may be seen in FIG. 1, that I envision my invention as having its greatest applicability in the driver, used by the golfer to hit the ball from the tee. It should be understood, however, that the principles of construction which are disclosed and claimed herein may well be as applicable to the fairway woods and irons; thus, by describing and depicting the invention in connection with the driver, I do not intend to limit the use of the invention to this particular club. Likewise, modern "woods" are not all made from wood and the instant invention is applicable to traditional woods as well as metal woods.

Figure 2:
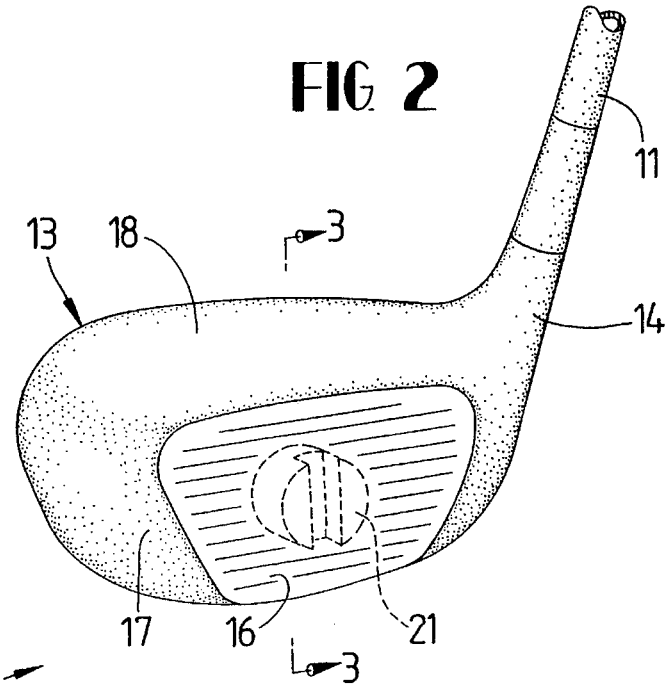
FIG. 2 is a perspective view of a club head showing the present invention in phantom.

As seen in FIG. 1 the golf club includes a shaft 11, a grip 12, and a head 13. My invention is concerned with the construction of the head 13, thus the remaining figures substantially eliminate the shaft and grip. As may be seen in FIG. 2, the head 13 extends from the shaft 11 outwardly and is defined by the hosel 14, striking face 16 and the toe 17. The body 18 of the head between the hosel and the toe is located rearwardly of the striking plate 16 as is well known in the art. The body 18 provides ample room within which my invention may be employed.

Figure 4:
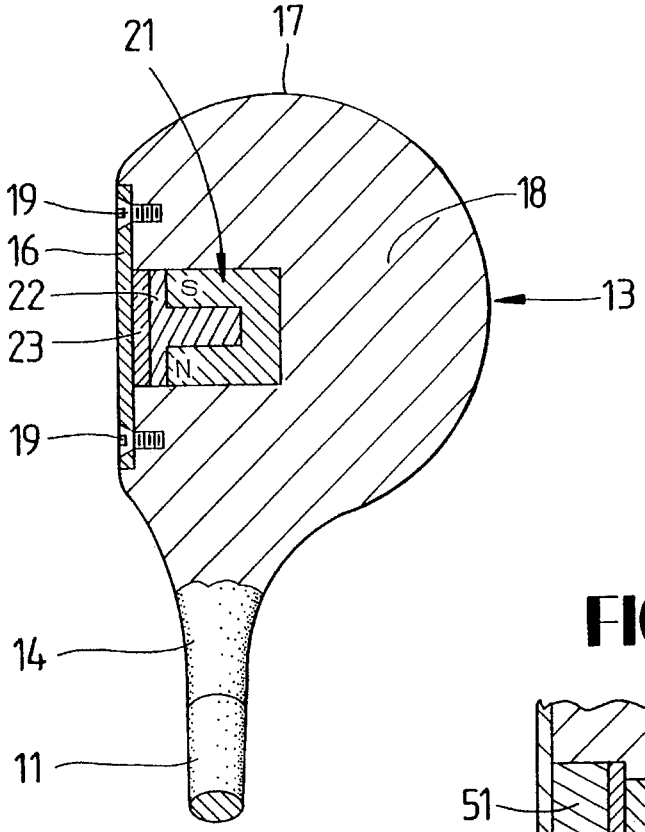
FIG. 4 is a sectional view perpendicular to the view of FIG. 3 and the striking face of the club.
Figure 5:
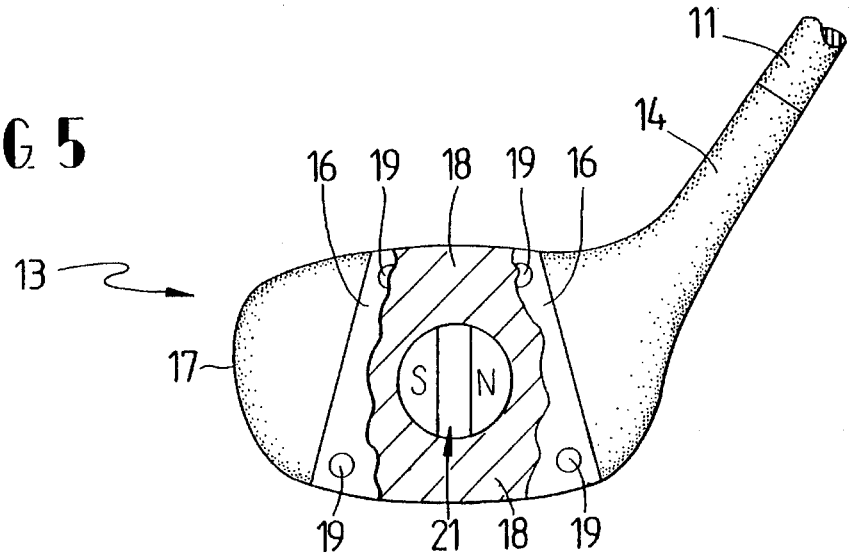
FIG. 5 is a front elevational view partially broken away to illustrate the invention positioned at the "sweet spot"

Note that the striking plate 16 is a hard region, which in wooden clubs may be a plate of a hardened material attached to the body of the head by a set of screws 19, which overlies the center of gravity of the club, which is referred to as the sweet spot. As is well known, hitting the ball at the sweet spot is the intention of the golfer, however it is somewhat more difficult than a non-golfer would imagine. In my invention, I form a cavity in the body into which I seat a permanent magnet 21 in alignment with the sweet spot and the loft of the striking plate, as shown in FIG. 5. The permanent magnet of choice is a horseshoe magnet or a variant thereon such as a button magnet which also has north and south poles in lateral relation. As shown in FIG. 4, the poles of the magnet are positioned facing the strike plate and are covered by a layer of non-magnetic spacer 22 material such as nylon, mylar or an adhesive layer. In a wooden club or any metallic club wherein the strike plate is non-magnetic, a keeper plate 23 of a ferromagnetic material is placed across the poles separated therefrom by the spacer 22. The striking plate thus overlies the magnet assembly. Where the club design is such that the striking plate itself is ferromagnetic, then the striking plate will serve as the effective keeper and no additional keeper plate is needed. Note that the keeper must be separated from the poles of the magnet by the spacer. Although I do not imply that the following measurements are critical to the utilization of the invention, it may be helpful for others to confirm and duplicate my club to know that the magnetic strength is between 1000 to 6000 gauss and the magnet weighs between 8 and 20 grams for a driver and between 4 and 40 grams for all other clubs. The spacer thickness varies between 0.003 and 0.25 inches. From my observations, a space must exist between the magnet and the ferromagnetic keeper plate.

Figure 4A:
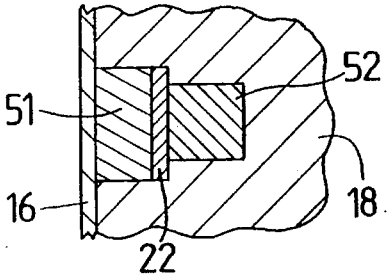
FIG. 4A shows a dual magnet arrangement.

An alternative construction is shown in FIG. 4A, wherein I employ a pot magnet 51, a spacer 22, and a rare earth magnet 52. In this construction, the magnetic field is set up between the two permanent magnets.

It is important to note that the variation in mass of the club is not dramatically altered by the use of the invention, nor should the mere variation in weight cause the level of difference in performance observed with my prototype woods. To test whether the improved performance was due to the mass or whether to some magnetic phenomenon, I prepared duplicate woods in which I inserted non-magnetic assemblies of the same physical description as the above magnetic assembly and had two accomplished golfers "blind test" the two versions without knowing which club contained the magnet assembly or even what was in the clubs. Using a metal wood, the two golfers drove identical balls an average of 291.3 and 288.7 yards off the tee when the magnetic assembly was present. This compared to average drives of 255.1 and 268.6 yards using an identical club which had the non-magnetic assembly in place. Similar results were attained using a persimmon wood with the magnetic and non-magnetic assemblies in place.

Figure 3:
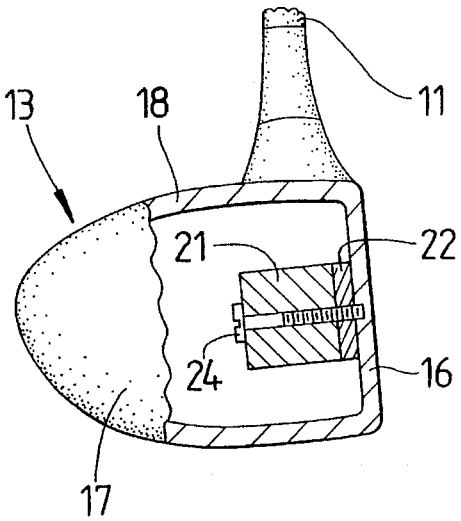
FIG. 3 is a sectional view along line 3—3 of FIG. 2.
Figure 6:
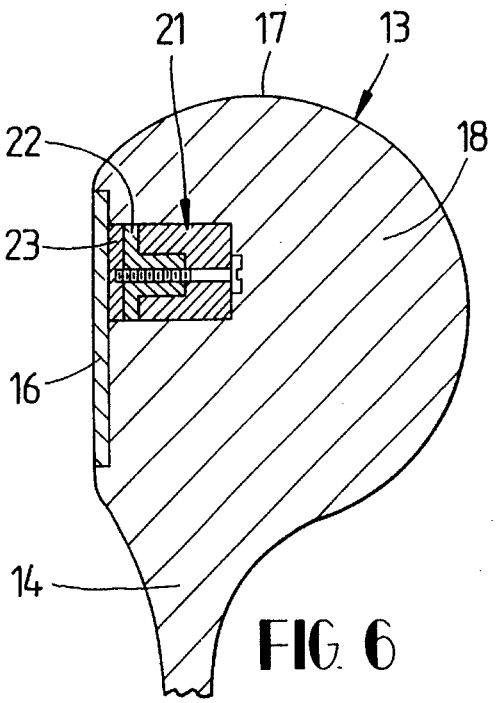
FIG. 6 is a sectional view along the same line as FIG. 4 showing my invention displaced toward the toe of the club head.
Figure 7:
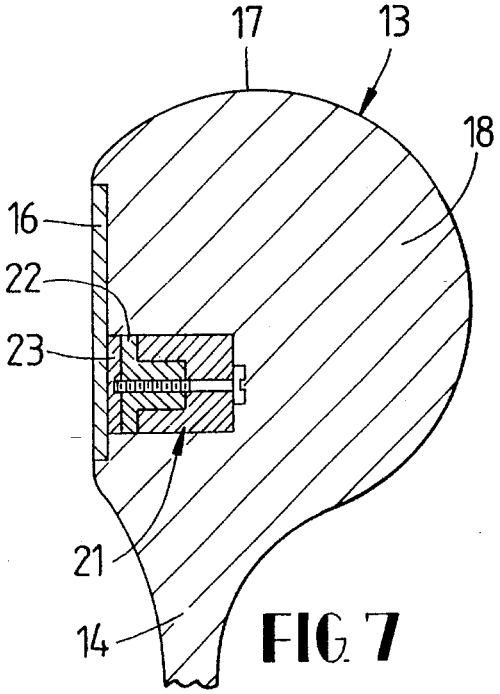
FIG. 7 is a sectional view as in FIG. 6 showing my invention displaced toward the heel of the club head.
Figure 8:
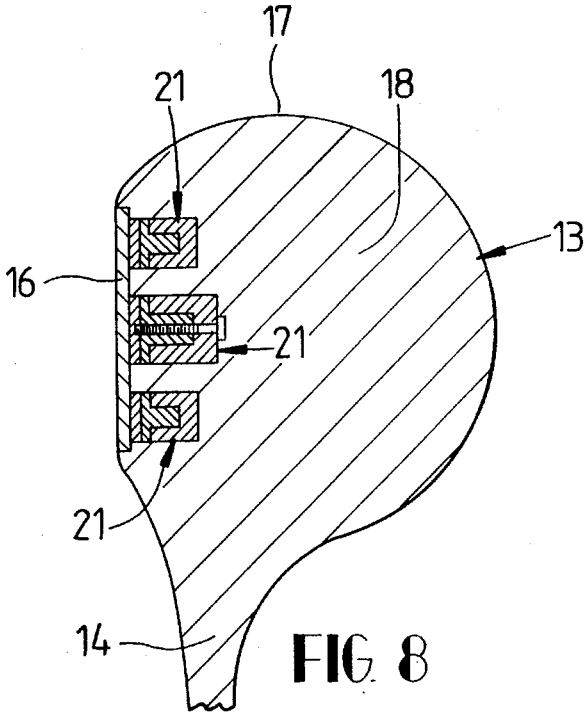
FIG. 8 is a sectional view as in FIG. 7 showing multiple magnets in a club head.

It will be appreciated that the rules of golf forbid the use of a club with a moving part in it; thus, the magnetic assembly is fixed in place with adhesive and a screw 24 as in FIG. 3. Thus, there does not appear to be any possibility of a mechanical rebound in the construction. I have also learned that by orienting the poles of the magnet such that the north pole is closest to the heel of the club head, as in FIG. 4, the tendency to slice the ball, i.e. imparting a clockwise spin for a right handed golfer causing the ball to fade to the right of the intended course, is greatly reduced. Likewise, placing the magnet off center toward the hosel, as in FIG. 7, reduces the tendency to slice the ball and placing the magnet off center toward the toe, FIG. 6, reduces the tendency to hook. As noted in FIG. 8, the club may even have a central main magnet assembly with one or two minor magnet assemblies at the heel or toe side to increase distance and reduce the tendency of the club head to strike the ball at an angle.

While I do not know why the phenomenal results are achieved, the necessity of the flux field being present in the non-magnetic spacer indicates that movement of the club in the arc required to strike the ball interacts with the magnetic field of the earth in a manner which resists the change in inertia when the ball is struck, thus providing an extra pseudo mass to the club head as it strikes the ball.

While I have shown my invention in one form, it will be obvious to those skilled in the art that it is not so limited but is susceptible of various changes and modifications without departing from the spirit thereof.

What I claim is:

1. In a golf club construction wherein the club includes a shaft having a grip and a head affixed to the shaft at an end distal the grip, said head including a striking face which addresses a golf ball and is inclined relative to the ball at impact, the improvement comprising:

(a) at least one magnet enclosed within said head, said at least one magnet having opposite poles, each of said poles facing said striking face; and (b) a non-magnetic spacer lying in a plane parallel to said striking face and abutting said opposite poles, said magnet and spacer being rigidly positioned in said head proximal said striking face.

2. A golf club as in claim 1 wherein said striking face is made of a ferromagnetic material and is separated from said magnet by said spacer.

3. A golf club as in claim 1 wherein a ferromagnetic plate is positioned in abutting relationship with said spacer and adjacent said striking face.

4. A golf club as in claim 1 wherein said magnet is centered on a portion of the striking face defining the preferred impact zone for a golf ball.

5. A golf club as defined in claim 1 wherein said magnet is positioned laterally in said head relative to said shaft at a position distal said shaft.

6. A golf club as defined in claim 1 wherein said magnet is positioned laterally in said head relative to said shaft and proximal thereto.

7. A golf club as defined in claim 1 further comprising a second magnet of smaller size and strength positioned laterally of said magnet, and having the same configuration as said magnet and a cooperative spacer aligned parallel to said striking face.

8. A golf club as defined in claim 1 wherein said magnet is a horseshoe magnet.

9. A golf club as defined in claim 1 wherein said spacer is mylar.

10. A golf club as defined in claim 1 wherein said spacer is nylon.

11. A golf club comprising a shaft and a head affixed to one end of said shaft, said head including a striking face for impacting a golf ball and a permanent magnet affixed within said head proximal a predetermined region of said striking face, wherein said permanent magnet has opposite poles with said poles positioned proximal said striking face.

12. A golf club as defined in claim 4 wherein said means for establishing further comprises a non-magnetic spacer intermediate said permanent magnet and said striking face.

13. A golf club as defined in claim 12 wherein said means for establishing comprises a ferromagnetic plate affixed to said spacer and lying in a plane parallel to said striking face, such that magnetic flux lines from said permanent magnet pass through said spacer to said plate.

14. A golf club as defined in claim 12 where in said spacer is a layer of adhesive material.

15. A golf club as defined in claim 12 wherein said space is mylar.

16. A golf club as defined in claim 4 further comprising a rare earth magnet positioned rearwardly of said permanent magnet and separated therefrom by a non-magnetic spacer.

* * * * *